United States Patent [19]

Hussamy

[11] Patent Number: 4,705,527

[45] Date of Patent: Nov. 10, 1987

[54] PROCESS FOR THE PRINTING OF SHAPED ARTICLES DERIVED FROM ARAMID FIBERS

[75] Inventor: Samir Hussamy, Lynchburg, Va.

[73] Assignee: Burlington Industries, Inc., Greensboro, N.C.

[21] Appl. No.: 863,011

[22] Filed: May 14, 1986

[51] Int. Cl.[4] ..... C09B 67/00

[52] U.S. Cl. ..... 8/558; 8/490; 8/574; 8/543; 8/586; 8/587; 8/650; 8/654; 8/680; 8/925; 8/938

[58] Field of Search ..... 8/558, 574, 581, 586

[56] References Cited

U.S. PATENT DOCUMENTS

| | | | |
|---|---|---|---|
| 2,225,603 | 12/1940 | Lubs | 8/402 |
| 2,290,945 | 7/1942 | Dahlen et al. | 8/564 |
| 2,989,360 | 6/1961 | Mautner | 8/553 |
| 3,558,267 | 1/1971 | Langenfeld | 8/586 |
| 3,741,719 | 6/1973 | Ramanathan et al. | 8/654 |
| 3,771,949 | 11/1973 | Hermes | 8/492 |
| 3,837,802 | 9/1974 | Litzler et al. | 8/549 |
| 3,884,626 | 5/1975 | Hoster et al. | 8/543 |
| 3,986,827 | 10/1976 | Dombchik | 8/527 |
| 4,059,403 | 11/1977 | Wolf et al. | 8/538 |
| 4,066,396 | 1/1978 | Wolf et al. | 8/489 |
| 4,525,168 | 6/1985 | Kelly | 8/130.1 |

FOREIGN PATENT DOCUMENTS 1282113 7/1972 United Kingdom .

OTHER PUBLICATIONS

"Dyeability of Nomex Aramid Yarn", by R. A. F. Moore et al., *Textile Research Journal*, pp. 254–260, 1985.

"Effect of Auxiliary Solvents in STX Coloration of Aramids and PBI with Cationic Dyes", in *Book of Papers, AATCC National Technical Conference*, Oct. 1983, pp. 314–326.

"Dyeing and Finishing Nomex Type 450 Aramid", *Bulletin NX-9*, Mar. 1978.

"Interactions of Nonaqueous Solvents with Textile Fibers, Part XI: Nomex Shrinkage Behavior", *Textile Res. J.*, 51, 323–331 (1981).

"Dyeability of Solvent Treated Fibers", *Book of Papers, AATCC National Technical Conference*, Moore et al., Oct. 1981, pp. 109–120.

"Interactions of Nonaqueous Solvents with Textile Fibers, Part II: Isotherman Shrinkage Kinetics of a Polyester Yarn", *Textile res. j.* 43, 176–183 (1973).

"Interactions of Nonaqueous Solvents with Textile Fibers, Part III: The Dynamic Shrinkage of Polyester Yarns in Organic Solvents", *Textile Res. J.*, →, 316–325.

"Interactions of Nonaqueous Solvents with Textile Fibers, Part VII: Dyeability of Polyester Yarns After Heat and Solvent-Induced Structural Modifications", *Textile Res. J.* 46, 574–587 (1976), Weigmann et al.

"Evaluation of the STX System for Solvent Dyeing of Industrial Fabrics Part II: Kevlar Aramid and PBI Fabrics", Cook et al., *Journal of Industrial Fabrics*, vol. 2, No. 1, Summer 1983.

"Dyeability of Nomex Aramid Yarn", Moore et al., *Book of Papers, 1982 Technical Conference", pp. 94–99 (19).*

"High-Temperature fibres and Their Identification", Prof. Maria Stratmann, *Melliand Textilberichte, (English Edition), Mar. 1982, pp. 215–219.*

"A Sovlent-Dyeing Process for Aramid Fibers", J. Preston et al., *Textile Research Journal*, May 1979, vol. 49, No. 5, pp 283–287.

*Primary Examiner*—A. Lionel Clingman

*Attorney, Agent, or Firm*—Nixon & Vanderhye

[57] ABSTRACT

A process of printing a predetermined pattern on a poly(m-phenyleneisophthalamide)-containing textile fabric comprises the successive steps of: (a) applying a print paste, composed of a highly polar solvent selected from the group consisting of dimethylsulfoxide, N,N-dimethylacetamide, N-methyl-2-pyrrolidone, and mixtures thereof, the polar solvent adapted to swell the aramid fiber and introduce a dyestuff therein, at least one organic dyestuff that is soluble in the polar solvent, a print paste thickening agent compatible with both the polar solvent and the dyestuff and water in a predetermined pattern onto the surface of the aramid textile; and (b) drying and curing the thus printed fabric at an elevated temperature sufficient to permeate and fix the dyestuff molecules inside the aramid fibers.

33 Claims, No Drawings

PROCESS FOR THE PRINTING OF SHAPED ARTICLES DERIVED FROM ARAMID FIBERS

This invention relates to a novel process for the printing of shaped articles derived from aramid fibers with conventional organic dyestuffs.

In particular, the present invention relates to the surprising discovery that particular print paste formulations are functional so as to enable one to print textile fabrics derived from aramid fibers with a variety of conventional organic dyestuffs to produce printed patterns of full tinctorial values having good overall fastness properties especially to washing, crocking, sublimation, and light without adversely affecting the excellent flame resistant and tensile properties of these fibers. Disclosed is a printing process in which conventional organic dyestuffs, i.e. cationic, anionic, fiber reactive, disperse, vat, solvent, azoic, and mixtures thereof, can now be utilized in accordance with this invention for the printing of aramid fabrics.

BACKGROUND OF THE INVENTION

High molecular weight wholly aromatic polyamides or aramids made by the condensation or reaction of aromatic or essentially aromatic monomeric starting material or materials described in U.S. Pat. No. 4,198,494 and sold under the trademarks Nomex by E. I. duPont de Nemours and Co., Conex by Teijin Corp., and Apyeil and Apyeil-A (Apyeil containing finely divided carbon) by Unitika Ltd. are extremely strong and durable and have excellent flame resistant properties. Shaped articles made of these aramid fibers such as yarn and textile fabrics are commercially important and gaining in popularity especially in the protective fabric field and other markets where the combined flame resistance and high tensile properties are essential.

A serious problem limiting the full commercial exploitation of the aramid fibers has been the fact that fabrics made from these highly crystalline fibers of extremely high glass transition temperature are very difficult to print into colored patterns and designs with good overall fastness properties, especially to light and washing, without adversely affecting their handle, tensile, and flame resistant properties.

Recently, it has been proposed in U.S. Pat. No. 4,525,168 to print aramid fabrics with anionic dyes, i.e. acid dyes, premetalized acid dyes, and direct dyes. This is accomplished by introducing into the aramid fiber dye site substances such as aromatic and aliphatic amines capable of forming ionic bonds with anionic dyes. The dye site substances are introduced and fixed inside the fiber by a special process prior to the printing operation. After printing the fabric with anionic dyestuff and drying, the printed fabric is turbo steamed under pressure to penetrate and fix the anionic dyestuff inside the fiber.

This process suffers a number of technical and economic drawbacks. It requires a special pretreatment process involving the use of specialty chemicals to provide the fiber with dye sites. Only anionic dyestuffs, i.e. dyestuffs containing one or more sulfonic acid groups or their sodium salts, can be used in the printing operation. Furthermore, it requires turbo steaming, a non-continuous operation to penetrate and fix the anionic dyes inside the fiber in order to develop the true shade and fastness properties of the prints. Further, experienced operators report that turbo steaming of printed fabrics tends to give rise to track-off problems in production.

In another development it has also been proposed by Cook and co-workers, Effect of Auxiliary Solvents in STX Coloration of Aramids and PBI with Cationic Dyes in "Book of Papers, AATCC National Technical Conference," New Orleans, La., Oct. 5–7, 1983, pp. 314–326, to improve the screen printing of Nomex aramid fabrics. In the procedure described the Nomex aramid fabric is pretreated in certain highly polar solvents such as DMSO under suitable conditions, i.e. pad-squeeze, heated at 150° F. for 10 minutes, washed at 100° F. and dried prior to the printing operation. In this case too, the fabric has to be pretreated in a special process prior to the printing operation as outlined above. Furthermore, such pretreatment if not properly controlled, may cause drastic reductions in the tensile and mechanical properties of the fabric.

Accordingly, it is an object of the present invention to provide an improved process for the printing of aramid fabrics. Another object of the invention is to provide a method whereby fabrics made of aramid fibers can be printed with a variety of conventional organic dyestuffs such as cationic, anionic, disperse, fiber reactive, solvent, vat, azoic, dyes as well as mixtures thereof to obtain printed patterns with superior overall fastness properties. The process allows the use of two or more dyestuffs of different classes in the same print paste formulation, and this is believed to be unique. Still another object of the invention is to provide an improved process for the printing of aramid fabrics in which penetration and fixation of dyestuffs inside the aramid fiber are achieved Finally, another object of the invention is to provide an improved process for the printing of aramid fabrics whereby the curing of the printed goods is carried out continuously under atmospheric pressure. Other objects of the invention will become apparent from a consideration of the description which follows.

DETAILED DESCRIPTION OF THE INVENTION

The present invention relates to the discovery that aramid fiber or products made from said fiber, such as textile fabrics, previously thought of as being very difficult to print into colored patterns and designs of good overall fastness properties without having, for example, to introduce into the fiber dye site substances in order to make them printable with anionic dyes as in U.S. Pat. No. 4,525,168, are nonetheless capable of being printed in a single step with a variety of organic dyestuffs using a specially formulated print paste. This unique print paste according to the present invention is capable of swelling the aramid fiber and permeating the dyestuff, which is also soluble in the print paste, inside the fiber. The swollen fiber is then collapsed and allowed to shrink back to its original dimensions by subsequent drying and curing operations thereby trapping and fixing the dyestuff inside the fiber.

Aramid fabrics can now be printed with this process thereby providing the printer with a wide range of dyestuffs, such as cationic dyes, anionic dyes, disperse dyes, fiber reactive dyes, vat dyes, azoic dyes, and solvent dyes from which to choose to print any color pattern required having outstanding overall fastness properties, especially to washing, dry cleaning, crocking, sublimation and light, without adversely affecting the handle and excellent mechanical and flame resistant properties of the aramid fabrics. The use of a combination of two or more dyes from different dyestuff classes in the same print paste formulation in the printing process, particularly on aramid fibers, is believed to be unique.

In addition, since this process does not require the introduction of dye site substances such as aromatic and aliphatic amines inside the fiber, does not use a pretreatment process prior to the printing operation, and does not require a turbo steaming operation under pressure to develop and fix the prints; aramid fabrics can now be efficiently and economically printed in practice.

The print paste of the present invention will preferably include about 3.0 to 4.0 parts thickening agent, 70 to 85 parts highly polar solvent, and 5 to 20 parts water; all parts are by weight. Other print paste adjuvants such as fire retardants, UV absorbers, antistatic agents, water repellants and other finishing and processing aids may also be present in the print paste. A tinctorial amount of at least one compatible dyestuff is, of course, included in the print paste.

The thickening agent used in the process can be any of the conventional thickeners for print pastes usable for printing textile materials such as natural starch, British gum, crystal gum, natural and etherified locust bean gums, carboxymethyl cellulose, gum tragacanth, polyacrylic acid sodium salt and sodium alginate, provided that it is soluble in the polar solvent or mixture of solvents used in the print paste and capable of forming a stable, homogeneous printing paste of appropriate viscosity to be able to be used in practice. Preferably the thickening agent will be of a polyacrylic acid type molecular weight range 450,000 to 4,000,000 and will be present in an amount sufficient so that the resulting print paste will have viscosity ranging between 5,000–36,000 cps.

The solvent used in the process can be any solvent capable of solvating the aramid fiber. By solvating is meant the formation of a complex between one or more molecules of the solvent and the aramid fiber molecules resulting in swelling of fibers and fibrids without dissolving or destroying them. Solvents such as N,N-dimethylformamide (DMF), dimethylsulfoxide (DMSO), N,N-dimethylacetamide (DMAC), and N-methyl-2-pyrrolidone (NMP), and combinations of 2 or more of these solvents have been found suitable as solvating agents in accordance with the present invention. In addition, none of these highly polar solvents cause an excessive reduction in mechanical properties.

Any organic dyestuff may be used. Such dyestuffs may be selected from cationic dyes, anionic dyes i.e. acid dyes, metalized acid dyes, direct dyes; solvent dyes, disperse dyes, fiber reactive dyes, vat dyes, and azoic dyes, provided that the dye selected is soluble in the print paste and does not affect the homogenity and stability of the print paste. Combinations of these dyes can also be used in the same print paste provided that they are soluble in the print paste and do not affect the homogenity and stability of the print paste. By way of example, organic dyestuffs which can be used according to the present invention are dyestuffs noted below in Tables 1–7.

TABLE 1

| CATIONIC DYES | |
|---|---|
| DYESTUFF | COLOR INDEX NO. |
| Astrazon Yellow 9GL 200% | Basic Yellow 13 |
| Sevron Brilliant Yellow F10G | Basic Yellow 40 |
| Astrazon Yellow 8GSL | Basic Yellow 63 |

TABLE 1-continued

| CATIONIC DYES | |
|---|---|
| DYESTUFF | COLOR INDEX NO. |
| Sevron Yellow 6DL | Basic Yellow 29 |
| Astrazon Orange RRL | Basic Orange 28 |
| Astrazon Orange G 200% | Basic Orange 21 |
| Sevron Brilliant Red 4G | Basic Red 14 |
| Basacryl Red GL | Basic Red 29 |
| Sevron Red B | Basic Red 15 |
| Astrazon Pink FBB | Basic Red 49 |
| Astrazon Brill Red 4G | |
| Sevron Red 2B | Basic Violet 16 |
| Astrazaon Red Violet FRR | Basic Violet 20 |
| Astrazon Violet F3RL | Basic Violet 21 |
| Astrazon Blue BG 200% | Basic Blue 3 |
| Astrazon Blue FRR 200% | Basic Blue 29 |
| Basacryl Blue GL | Basic Blue 64 |
| Astrazon Green BL 200% | Basic Green 6 |

TABLE 2

| ACID & METALIZED ACID DYES | |
|---|---|
| DYESTUFF | COLOR INDEX NO. |
| Irgalan Yellow 2GL | Acid Yellow 129 |
| Irgalan Yellow GRL | |
| Lanacron Yellow S-2G | |
| Nylanthrene Yellow FLW | Acid Yellow 159 |
| Intralan Yellow 3GL | |
| Nylanthrene Orange SLF | Acid Orange 116 |
| Irgalan Orange 2RL | |
| Intracid Rhodamine B | Acid Red 50 |
| Irgalan Red B-K | Acid Red 182 |
| Irgalan Red 4GL | Acid Red 259 |
| Irgalan Bordeaux GRL | Acid Red 213 |
| Lanacron Red S-G | |
| Nylanthrene Pink BLRF | |
| Nylanthrene Red B2B | |
| Nylanthrene Scarlet GYL Extra | |
| Supernylite Scarlet B | Acid Red 114 |
| Avilon Blue R-W | |
| Irgalan Blue 3GL 200% | |
| Nylanthrene Blue 2RFF | |
| Nylanthrene Blue 3BLF | |
| Nylanthrene Navy Blue LFWG | |
| Irgalan Navy Blue B-KWL | |
| Lanacron Navy Blue S-G KWL | |
| Neutral Cyanine Green GK Extra | Acid Green 25 |
| Irgalan Olive 3BL | Acid Green 70 |
| Irgalan Green GNL | |
| Lanasyn Green S4GL | Acid Green 106 |
| Lanacron Red Brown S-R | |
| Avilon Brown GL-W | |
| Irgalan Brown 2GL-KWL | Acid Brown 44 |
| Irgalan Brown 2RL-KWL | Acid Brown 45 |
| Irgalan Brown 3BL | Acid Brown 46 |
| Irgalan Brown GRL-KWL | Acid Brown 227 |
| Irgalan Red Brown RL | |
| Avilon Dark Brown BRL-W | |
| Nylanthrene Brown RSM | |
| Irgalan Black BGL | Acid Black 107 |
| Irgalan Black GBL | Acid Black 131 |
| Irgalan Black RBL | Acid Black 132 |
| Nylon Black PVF | |
| Irgalan Grey BL-KWL | Acid Black 58 |
| Irgalan Grey BRLA | Acid Black 60 |

TABLE 3

| DIRECT DYES | |
|---|---|
| DYESTUFF | COLOR INDEX NO. |
| Superlite Fast Yellow EFC | Direct Yellow 106 |
| Diphenyl Orange EGLL | Direct Orange 39 |
| Pyrazol Red 7BSW | Direct Red 80 |
| Solophenyl Red TBD | |
| Superlite Fast Blue 8GLN | Direct Blue 191 |
| Solophenyl Blue ARF | |
| Intralite Blue NBLL | Direct Blue 80 |
| Intralite Turquoise 8GL | Direct Blue 86 |
| Atlantic Blue 5GL 250% | |

TABLE 3-continued

| DIRECT DYES | |
|---|---|
| DYESTUFF | COLOR INDEX NO. |
| Cuprophenyl Navy Blue RL 200% | Direct Blue 160 |
| Indosol Navy SF-BL 240% | |
| Indosol Brown SF-BR | |
| Diphenyl Black OB 150% | Direct Black 80 |

TABLE 4

| VAT DYES | |
|---|---|
| DYESTUFF | COLOR INDEX NO. |
| Indigosol Blue IBC | Solubilized Vat Blue 6 |
| Indigosol Blue 14G | |
| Indigosol O Extra | Solubilized Vat Blue 1 |

TABLE 5

| DISPERSE DYES | |
|---|---|
| DYESTUFF | COLOR INDEX NO. |
| Intrasil Yellow RPM | Disperse Yellow 41 |
| Terasil Yellow GWL | Disperse Yellow 42 |
| Terasil Yellow 2GW | Disperse Yellow 54 |
| Terasil Yellow 3GB | Disperse Yellow 64 |
| Eastman Yellow BRLF | Disperse Yellow 108 |
| Samaron Yellow 6GSL | Disperse Yellow 114 |
| Dispersol Yellow 7GPC | Disperse Yellow 126 |
| Samaron Yellow H10GF | Disperse Yellow 199 |
| Foron Brilliant Yellow S-7GL | Disperse Yellow 210 |
| Polycron Dianix Yellow ANFS | |
| Polycron Dianix Yellow AC-E | |
| Polycron Dianix Yellow U-SE | |
| Intrasil Orange YBLH | Disperse Orange 29 |
| Terasil Orange 4RL | Disperse Orange 41 |
| Intrasil Orange FR | |
| Terasil Red 5G | Disperse Red 50 |
| Resolin Red FB | Disperse Red 60 |
| Palanil Rubine FL | Disperse Red 73 |
| Palanil Pink REL | Disperse Red 91 |
| Terasil Pink 2GLA | Disperse Red 86 |
| Foron Red SGL | Disperse Red 121 |
| Terasil Red VGA | Disperse Red 128 |
| Resolin Red BLS | Disperse Red 159 |
| Intrasil Bordeaux 3BSK | Disperse Red 167.1 |
| Sodyecron Red ST | Disperse Red 263 |
| Dispersol Red 4GPC | Disperse Red 278 |
| Dispersol Red 2BPC | Disperse Red 288 |
| Dispersol Rubine 3B-PC | Disperse Red 311 |
| Resolin Red F3BS | Disperse Red 343 |
| Eastmand Red YSL | |
| Resolin Rubine GL | |
| Polycron Dianix Carmine USE | |
| Polycron Dianix Red ACE | |
| Polycron Dianix Red USE | |
| Palanil Luminous Red G | |
| Terasil Rubine 2GFL | |
| Artisil Violet RL | Disperse Violet 28 |
| Resolin Red Violet FBL | Disperse Violet 31 |
| Palanil Violet 4REL | Disperse Violet 35 |
| Sodyecron Violet B5R | Disperse Violet 36 |
| Terasil Blue GLF | Disperse Blue 27 |
| Dispersol Navy BT | Disperse Blue 35 |
| Resolin Blue FBL | Disperse Blue 56 |
| Palanil Blue BG | Disperse Blue 60 |
| Intrasil Brilliant Blue BNS | Disperse Blue 60 |
| Terasil Blue 4R | Disperse Blue 64 |
| Foron Navy SMEM | Disperse Blue 79 |
| Resolin Blue KTW | Disperse Blue 81 |
| Samaron Blue HBL-A | Disperse Blue 95 |
| Palanil Dark Blue 3RT | Disperse Blue 148 |
| Samaron Blue GSL | Disperse Blue 165 |
| Sodyecron Navy ARLF | Disperse Blue 281 |
| Dispersol Blue R-PC | Disperse Blue 284 |
| Dispersol Blue 5G-PC | Disperse Blue 288 |
| Samaron Dark Blue BBA | Disperse Blue 333 |
| Terasil Navy TWB | |
| Resolin Blue GFL | |
| Terasil Blue BFL | |
| Resolin Blue GFL-B | |

TABLE 5-continued

| DISPERSE DYES | |
|---|---|
| DYESTUFF | COLOR INDEX NO. |
| Polycron Dianix Blue FGLE | Disperse Blue 56 |
| Polycron Dianix Blue USE | |
| Foron Blue SE-FBL | |
| Dispersol Green C-6B | Disperse Green 9 |
| Interasil Brown 3R | Disperse Brown 1 |
| Dispersol Brown 3GPC | Disperse Brown 19 |
| Palanil Yellow Brown REL | |
| Foron Black OBN | |

TABLE 6

| SOLVENT DYES | |
|---|---|
| DYESTUFF | COLOR INDEX NO. |
| Savinyl Yellow 2RLS | Solvent Yellow 62 |
| Neozapon Yellow 141 | Solvent Yellow 81 |
| Neozapon Yellow 157 | Solvent Yellow 82 |
| Savinyl Yellow RLSN | Solvent Yellow 83 |
| Fluorol Yellow 088 | Solvent Green 4 |
| Savinyl Orange RLS | Solvent Orange 41 |
| Neozapon Orange 251 | Solvent Orange 54 |
| Neozapon Orange 245 | Solvent Orange 56 |
| Neozapon Orange 275 | Solvent Orange 70 |
| Neozapon Red 492 | Solvent Red 35 |
| Neptune Red Base 543 | Solvent Red 49 |
| Savinyl Scarlet RLS | Solvent Red 92 |
| Neozapon Red 346 | Solvent Red 109 |
| Zapon Red 471 | Solvent Red 118 |
| Neozapon Red 395 | Solvent Red 122 |
| Savinyl Red 3BLS | Solvent Red 91 |
| Savinyl Red 3GLS | Solvent Red 124 |
| Savinyl Pink 6BLS | Solvent Red 127 |
| Thermoplast Red Solvent Red 138 | |
| Neozapon Red 334 | Solvent Red 160 |
| Thermoplast Red 454 | Solvent Red 195 |
| Neozapon Red 335 | Solvent Red 119 |
| Savinyl Blue RLS | Solvent Blue 45 |
| Zapon Blue 806 | Solvent Blue 25 |
| Baso Blue 645 | Solvent Blue 4 |
| Neptune Blue 722 | Solvent Blue 38 |
| Savinyl Blue GLS | Solvent Blue 44 |
| Neptune Blue 698 | Solvent Blue 64 |
| Neozapon Blue 807 | Solvent Blue 70 |
| Baso Blue 688 | Solvent Blue 81 |
| Neozapon Brown 287 | Solvent Brown 58 |
| Savinyl Green GLS | |
| Fluorol Green Gold 084 | Solvent Green 5 |
| Neozapon Black X-S1 | |
| Savinyl Black RLS | Solvent Black 45 |

TABLE 7

| FIBER REACTIVE DYES | |
|---|---|
| DYESTUFF | COLOR INDEX NO. |
| Procinyl Scarlet G | Reactive Red 10 |
| Procinyl Red G | Reactive Red 44 |
| Procion Blue HB | Reactive Blue 2 |
| Procion Blue MXR | Reactive Blue 4 |
| Procinyl Blue R | Reactive Blue 6 |
| Levafix Blue EG | Reactive Blue 21 |
| Levafix Blue RRN | Reactive Blue 24 |
| Levafix Blue EB 200% | Reactive Blue 29 |
| Levafix Blue P-3GL | Reactive Blue 54 |
| Levafix Blue P-3RL | Reactive Blue 65 |
| Levafix Blue P-RRL | Reactive Blue 67 |
| Procion Turquoise HA | Reactive Blue 71 |
| Levafix Blue ER | |
| Levafix Blue ESN | |
| Procion Blue M3GS | |
| Procion Blue R | |
| Procion Blue HBS | |
| Procion Blue MX3G | |
| Procion Turquoise H7G | |
| Procion Turquoise SP2G | |
| Procion Turquoise H5G | |
| Procion Green H7GS | |

TABLE 7-continued

| FIBER REACTIVE DYES | |
|---|---|
| DYESTUFF | COLOR INDEX NO. |
| Procion Green HE48D | |

The aramid fiber for which the present invention is particularly well suited can be in any suitable structural form i.e., light, medium and heavy weight woven and knitted fabrics of different weaves constructed from continuous filament and spun yarns of different types and counts, non-woven, felt and carpet materials.

The terms high molecular weight aromatic polyamide or aramid as used herein are to be understood as those described in U.S. Pat. No. 4,198,494, the disclosure of which is hereby incorporated by reference, and as meaning a high molecular weight synthetic organic polyamide made by the condensation or reaction of aromatic or essentially aromatic monomeric starting material or materials. Thus, in the case of aromatic monomeric starting material or materials the reactants are aromatic diamines and aromatic diacids (or derivatives of such acids), and the polymer repeating unit structure of the resulting aromatic polyamide in one instance may be illustrated by the following structural formula:

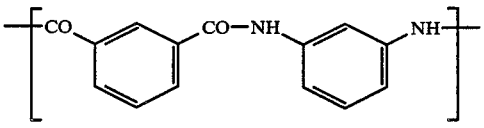

poly(m-phenyleneisophthalamide)

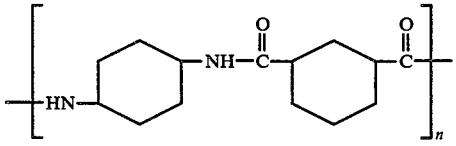

Thse fibers are sold under the trademarks Nomex by E. I. duPont de Nemours and Co., Conex by Teijin Corp., and Apyeil and Apyeil-A (Apyeil containing finely divided carbon) by Unitika. Fabrics made of these fibers are extremely strong and have excellent flame resistant properties. However, other kinds of suitable wholly aromatic polyamides are known in the literature, and the present invention is believed to be useful for all such other kinds as well. The suitability of a particular fiber or type of fiber to the process of this invention can readily be determined by a single test. Dyeing of the fiber is acceptable; staining of a candidate fiber is not. For further detailed information on the chemistry, structure, and the nature of the wholly aromatic polyamides to which this invention is applicable reference is made to Mark and Gaylord, Encyclopedia of Polymer Science and Technology, Vol. 10, 1969, pages 583–597; also Chapter 6 entitled "New Linear Polaymide" of New Linear Polymers, by Lee, Stoffey, and Neville, 1967, pages 129–169.

The process of the present invention can also be conveniently carried out using conventional printing techniques. For example, the fabric can be printed in those portions where colored patterns are required with the print paste of this invention. The thus printed fabric is dried at about 135° to 150° C. then cured for 2 to 5 minutes or so at 160° to 180° C. under atmospheric pressure. Residual unfixed dyestuffs, thickener and impurities from the printed goods are then removed from the textile fabric by subsequent washing treatments. Novel printed aramid fabrics, printed in any design or pattern, are also disclosed.

DESCRIPTION OF THE PREFERRED EMBODIMENT

The foregoing and other objects, features, and advantages of the present invention will be made more apparent by way of the following nonlimiting examples in which the parts and percentages noted are by weight unless otherwise indicated.

EXAMPLE 1

A plain weave aramid fabric made of intimate fiber blend of 95% Nomex/5% Kevlar (duPont T-455 Nomex) weighing 4 ozs./sq. yd. of staple warp and fill yarns 38/2, 26z//18s (15960 yds./lbs.), for use in garments offering protection against brief exposure to extreme thermal fluxes was printed in accordance with a predetermined pattern with a print paste having the following composition:

| | |
|---|---|
| Carbopol 934 - molecular weight approximately 3,000,000 (Acrylic acid polymer sold by B. F. Goodrich) | 3 parts |
| Dimethylsulfoxide (DMSO) | 82 parts |
| Sevron Yellow 6DL (Basic Yellow 29) | 5 parts |
| Water | 10 parts |

The fabric was then dried at 148° C. for 2 minutes, and subsequently cured for 3 minutes at 165° C. under atmospheric pressure. The cured fabric was then rinsed in cold and hot water, treated for 5 minutes in an aqueous solution of 0.5% sodium carbonate and 0.2% of a non-ionic detergent at 80° C., rinsed in hot water followed by cold water, and finally dried.

A bright reddish yellow print pattern of good overall fastness properties was obtained without any adverse affect on the excellent tensile and flame resistance properties of the fabric. A cross-section photomicrograph of the printed fibers revealed that the dyestuff molecules completely penetrated and fixed inside the fiber.

EXAMPLE 2

The procedures given in Example 1 were repeated using the following dye in the print paste:

Basacryl Red GL (C.I. Basic Red 29) 2 parts

A red print pattern of good overall fastness properties was obtained without any adverse effect on the excellent tensile and flame resistance properties of the fabric. The dyestuff molecules were completely penetrated and fixed inside the fiber as shown in cross-section photomicrograph.

EXAMPLE 3

The procedures of Example 1 were repeated using the following dye in the print paste.

Basacryl Blue GL (C.I. Basic Blue 54) 5 parts

A dark blue pattern with the same type of results was obtained as in Examples 1 & 2 above. Complete dye penetration inside the fiber was achieved.

EXAMPLE 4

The above procedures of Example 1 were repeated using the following cationic dyestuffs in the print paste;

| | |
|---|---|
| Sevron Yellow 6DL (C.I. Basic Yellow 29) | 29 parts |
| Basacryl Red GL1 (C.I. Basic Red 29) | 2.5 parts |
| Basacryl Blue GL (C.I. Basic Blue 54) | 2.5 parts |

A solid black pattern of good overall fastness properties was obtained without any adverse effect on the tensile and flame resistance properties of the fabric. The dyestuffs molecules were completely penetrated and fixed inside the fiber as shown in cross-section photomicrograph.

EXAMPLE 5

The above procedures of Example 1 were repeated using a metalized acid dyestuff in a print paste having the following composition:

| | |
|---|---|
| Carbopol 934 | 4 parts |
| DMSO | 81 parts |
| Irgalan Yellow 2GL (C.I. Yellow 129) | 3 parts |
| Water | 12 parts |

A yellow print pattern of good overall fastness properties was obtained with complete dye penetration and fixation inside the fiber while the original excellent tensile and flame resistant properties of the fabric were not adversely affected.

EXAMPLE 6

The procedures of Example 1 were repeated using 3 parts of the metalized acid dyestuff Nylanthrene Red B2B in the print paste of Example 5. A bright red print pattern of good overall fastness properties was obtained with complete dye penetration and fixation inside the fiber. The fabric's original excellent tensile and flame resistant properties were not affected by the printing process.

EXAMPLE 7

The procedures of Example 1 were repeated this time using three parts of the metalized acid dyestuff Nylanthrene Blue LFWG in the print paste of Example 5. A dark blue print pattern of good overall fastness properties was obtained. Complete dye penetration and fixation inside the fiber was achieved and the fabric's properties were not adversely affected in any way.

EXAMPLE 8

The procedures of Example 1 were repeated using 3 parts of the direct dye Pyrazol Red 7BSW (C.I. Direct Red 80) in the print paste of Example 5. A bright red print pattern with complete dye penetration and fixation inside the fiber was obtained with the same type of results obtained in the previous examples.

EXAMPLE 9

The procedures of Example 1 were repeated using 3 parts of direct dye Diphenyl Orange EGLL (C.I. Direct Orange 39) in the print paste. A bright orange print pattern with good overall fastness properties and complete dye penetration and fixation inside the fiber was obtained.

EXAMPLE 10

The procedures of Example 1 were repeated using 3 parts of the solubilized vat dye Indigosol Blue 1BS (C.I. Solubilized Vat Blue 6) in the print paste of Example 5. A dark blue print pattern with good wash fastness properties and complete dye penetration and fixation inside the fiber was obtained.

EXAMPLES 11–14

The procedures of Example 1 were repeated using the following disperse dyes in the print paste:

| | | |
|---|---|---|
| EXAMPLE 11: | Foron Black OBN | 6 parts |
| EXAMPLE 12: | Foron Blue SE-FBL | 3 parts |
| EXAMPLE 13: | Terasil Pink 2GLA (C.I. Disperse Red 86) | 3 parts |
| EXAMPLE 14: | Terasil Yellow 2GW (C.I. Disperse Yellow 54) | 3 parts |

Solid black, dark blue, bright red, and greenish yellow print patterns with good overall fastness properties and complete dyes penetration and fixation inside the fiber were respectively obtained while the otherwise excellent tensile and flame resistant properties of the fabric were not affected in any way.

EXAMPLES 15–17

The procedures of Example 1 were repeated using the following solvent dyes in the print paste:

| | | |
|---|---|---|
| EXAMPLE 15: | Savinyl Blue RLS (C.I. Solvent Blue 45) | 3 parts |
| EXAMPLE 16: | Neozapon Red 335 | 3 parts |
| EXAMPLE 17: | Neozapon Orange 251 (C.I. Solvent Orange 54) | 3 parts |

Reddish blue, maroon and dark orange print patterns with good overall fastness properties and complete penetration and fixation inside the fiber were respectively obtained and the otherwise excellent tensile and flame resistant properties of the fabric were not adversely affected.

EXAMPLES 18–20

The procedure of Example 1 were repeated using the following reactive dyes in the print paste.

| | | |
|---|---|---|
| EXAMPLE 18: | Levafix Blue ER (C.I. Reactive Blue 21) | 3 parts |
| EXAMPLE 19: | Procinyl Red G (C.I. Reactive Red 44) | 3 parts |
| EXAMPLE 20: | Procion Turquoise H7G | 3 parts |

Blue, dark red and turquoise print patterns with complete dye penetration and fixation inside the fiber were respectively obtained. The printed fabrics had good overal fastness properties with no adverse effect on the tensile and flame resistant properties of the fabric.

EXAMPLE 21

The procedures of Example 1 were repeated using the following mixture of acid and basic dyes in the print paste:

| | |
|---|---|
| Intracid Rhodamine B (C.I. Acid Red 50) | 1 part |
| Sevron Brilliant Yellow F10G (C.I. Basic Yellow 40) | 3 parts |

A bright fluorescent red print pattern with good overall fastness properties and complete dye penetration and fixation inside the fiber was obtained with no adverse effect on the tensile and flame resistant properties of the fabric.

EXAMPLE 22

The procedures of Example 1 were repeated this time using a mixture of cationic and direct dyes in the print paste.

| | |
|---|---|
| Sevron Brilliant Yellow F10G (C.I. Basic Yellow 40) | 3 parts |
| Intralite Turquoise 8GL (C.I. Direct Blue 86) | 0.5 parts |

A bright fluorescent green print pattern with good overall fastness properties and complete dyes penetration and fixation inside the fiber was obtained with no adverse effects on the tensile and flame resistant properties of the fabric.

Other embodiments of the invention will be apparent to one skilled in the art from a consideration of the specification or the practice of the invention disclosed herein. It is intended that the specificaiton and examples be considered as exemplary only, with the true scope and spirit of the invention being indicated by the following claims.

What is claimed is:

1. A process of printing a predetermined pattern on a poly(m-phenyleneisophthalamide) textile fabric comprising the successive steps of:

(a) applying a print paste, consisting essentially of a higher polar solvent poly(m-phenyleneisophthalamide) fiber swelling agent adapted to swell the poly(m-phenyleneisophthalamide) fiber and introduce a dyestuff therein, the highly polar solvent selected from the group consisting of dimethylsulfoxide, N,N-dimethylformamide, N,N-dimethylacetamide, N-methyl-2-pyrrolidone, and mixtures thereof, at least one organic dyestuff that is soluble in the polar solvent, a print paste thickening agent that is soluble in the polar solvent and compatible with both the polar solvent and the dyestuff and water in an amount of from about 5 to about 20% by weight, in a predetermined pattern onto the surface of the poly(m-phenyleneisophthalamide) textile; and (b) drying and curing the thus printed fabric at an elevated temperature sufficient to permeate and fix the dyestuff molecules inside the poly(m-phenyleneisophthalamide) fibers.

2. The process of claim 1 including the additional step of:

(c) rinsing and washing the printed and cured fabric to remove any residual print paste and unfixed dyestuff from the fabric.

3. The process of claim 1 in which the fabric is cured in step (b) at a temperature in the range of about 115° C. to about 190° C.

4. The process of claim 3 in which the fabric is cured for a period of from about 2 to about 5 minutes.

5. The process of claim 1 in which the textile material textile fabric is composed entirely of Poly(m-phenyleneisophthalamide) fibers.

6. The process of claim 1 in which the print paste includes thickening agent composed of an acrylic acid polymer.

7. The process of claim 1 in which the highly polar solvent is present in an amount of between about 70 and 85% by weight.

8. The process of claim 1 in which the print paste contains at least one organic dyestuff which is completely soluble in the print paste.

9. The process of claim 1 in which a UV absorber, an antistatic agent or a water repellant is also present in the print paste and is applied to the fabric.

10. A print paste for printing a predetermined pattern on poly(m-phenyleneisophthalamide) textile fabrics consisting essentially of:

at least 70 weight percent of a highly polar solvent poly(m-phenyleneisophthalamide) fiber swelling agent adapted to swell the poly(m-phenyleneisophthalamide) fiber and introduce a dyestuff therein, the highly polar solvent selected from the group consisting of dimethylsulfoxide, N,N-dimethylformamide, N,N-dimethylacetamide, N-methyl-2-pyrrolidone and mixtures thereof;

a thickening amount of a viscosity building print paste thickener that is compatible with and soluble in the polar solvent;

a tinctorial amount of at least one organic dyestuff that is soluble in the polar solvent; and balance water in an amount of from about 5 to about 20% by weight.

11. The print paste of claim 10 in which the thickener is a polyacrylic acid having a molecular weight in the range of from about 450,000 to about 4,000,000.

12. The print paste of claim 11 having a viscosity in the range of from 5,000 to 36,000 cps.

13. The print paste of claim 10 in which the highly polar solvent is a mixture of two or more of the highly polar solvents.

14. The print paste of claim 10 in which the highly polar solvent is present in an amount of between about 70 and about 85% by weight.

15. The print paste of claim 10 in which the organic dyestuff is a cationic dyestuff.

16. The print paste of claim 10 in which the organic dyestuff is an anionic dyestuff.

17. The print paste of claim 10 in which the organic dyestuff is a solvent dyestuff.

18. The print paste of claim 10 in which the organic dyestuff is a disperse dyestuff.

19. The print paste of claim 10 in which the organic dyestuff is a reactive dyestuff.

20. The print paste of claim 10 in which the organic dyestuff is an azoic dyestuff.

21. The print paste of claim 10 in which the organic dyestuff is a vat dyestuff.

22. The print paste of claim 10 in which the organic dyestuff is an optical brightener.

23. The print paste of claim 10 in which the organic dyestuff is a mixture of anionic and cationic dyestuffs.

24. The print paste of claim 10 in which the organic dyestuff is a mixture of cationic and solvent dyestuffs.

25. The print paste of claim 10 in which the organic dyestuff is a mixture of anionic and solvent dyestuffs.

26. A stable, homogeneous print paste for printing and dyeing a poly(m-phenyleneisophthalamide) textile fabric in a predetermined pattern, the print paste consisting essentially, in percent by weight, of:

about 70 to about 85% of a highly polar solvent adapted to swell poly(m-phenyleneisophthalamide) fibers and introduce a dyestuff therein, the highly polar solvent selected from the group consisting of dimethylsulfoxide, N,N-dimethylformamide, N,N-dimethylacetamide, N-methyl-2-pyrrolidone, and mixtures thereof;

a tinctorial amount of an organic dyestuff soluble in the highly polar solvent and capable of dyeing and fixing in poly(m-phenyleneisophthalamide) fibers;

a print paste thickening agent soluble in the highly polar solvent and compatible with the organic dyestuff, the thickening agent together with the other ingredients present in an amount sufficient to provide the print paste with a viscosity in the range of about 5,000 to about 36,000 cps;

balance water in an amount of from about 5 to about 20% by weight.

27. The print paste of claim 26 in which the thickening agent is a polyacrylic acid having a molecular weight in the range of from about 450,000 to about 4,000,000.

28. The print paste of claim 26 in which the highly polar solvent is dimethylsulfoxide.

29. The print paste of claim 26 in which the organic dyestuff is selected fom the group consisting of cationic dyes, anionic dyes, disperse dyes, fiber reactive dyes, vat dyes, azoic dyes, solvent dyes, and mixtures thereof.

30. The print paste of claim 26 further including a UV absorber, an antistatic agent or a water repellant.

31. The process of claim 7 in which the thickening agent is present in the print paste in an amount of from about 3 to about 4% by weight.

32. The process of claim 31 in which the water is present in the print paste in an amount of from about 5 to about 20% by weight.

33. The print paste of claim 14 in which the thickener is present in an amount of from about 3 to about 4% by weight.

* * * * *